US006572498B2

(12) United States Patent
Nevers

(10) Patent No.: US 6,572,498 B2
(45) Date of Patent: Jun. 3, 2003

(54) BALL LAUNCHING RACKET

(76) Inventor: Larry J. Nevers, 8921 Widmer, Lenexa, KS (US) 66215

( * ) Notice: Subject to any disclaimer, the term of this patent is extended or adjusted under 35 U.S.C. 154(b) by 0 days.

(21) Appl. No.: 09/819,390

(22) Filed: Mar. 28, 2001

(65) Prior Publication Data

US 2002/0142869 A1 Oct. 3, 2002

(51) Int. Cl.[7] ..... A63B 51/02; A63B 69/00

(52) U.S. Cl. ..... 473/543; 473/540; 473/457; 473/463

(58) Field of Search ..... 473/543, 528, 473/532, 534, 540, 463, 457; 24/300, 301, 45

(56) References Cited

U.S. PATENT DOCUMENTS

| | | | | | |
|---|---|---|---|---|---|
| 1,558,507 | A | * | 10/1925 | Ryder | 473/532 |
| 1,907,529 | A | * | 5/1933 | Faure-Roux | 24/300 |
| 3,048,399 | A | * | 8/1962 | Breitbach | 473/457 |
| 3,507,494 | A | * | 4/1970 | Finkel | 273/395 |
| 3,582,073 | A | | 6/1971 | Meinick | |
| 3,647,211 | A | | 3/1972 | Doessel et al. | |
| 3,801,099 | A | | 4/1974 | Lair | |
| 4,139,194 | A | * | 2/1979 | Fischer | 473/521 |
| 4,185,822 | A | | 1/1980 | Li | |
| 4,566,695 | A | | 1/1986 | Melby | |
| 4,880,234 | A | | 11/1989 | Salisbury | |
| 5,143,370 | A | | 9/1992 | Richards | |
| 5,269,511 | A | * | 12/1993 | Chavez | 473/457 |
| 5,807,196 | A | * | 9/1998 | Pompeo | 473/463 |

FOREIGN PATENT DOCUMENTS

| | | | | |
|---|---|---|---|---|
| FR | 2581317 | * | 11/1986 | 473/FOR 185 |
| GB | 204113 | * | 9/1923 | 473/FOR 185 |
| GB | 652951 | * | 5/1951 | 473/FOR 178 |

* cited by examiner

*Primary Examiner*—Raleigh W. Chiu
(74) *Attorney, Agent, or Firm*—Thomas J. Schab

(57) ABSTRACT

An improved ball launching racket has a flexible net disposed within a central opening of a racket by a plurality of removable clip and elastomeric band assemblies. The construction of the clip facilitates expedient mounting and removal of the elastomeric bands, thereby allowing a user to expeditiously change the tension in the net, which in turn, changes the launching characteristics of the ball launching racket. The clip construction promotes usage of elastomeric bands that are free from apertures or slits, so that stress concentration points within the elatomeric bands are eliminated, increasing the useful life of each band.

12 Claims, 2 Drawing Sheets

BALL LAUNCHING RACKET

BACKGROUND OF THE INVENTION

1. Field of the Invention

This invention generally relates to sports equipment and more particularly to a racket for launching baseballs and softballs as a means for improving ball catching techniques.

More specifically, the invention concerns an improved ball launching racquet which can be quickly and effectively modified for use as either a ground ball or fly ball hitting device, and which can be interchanged between hardball and softball applications.

2. Discussion of the Prior Art

Conventional training rackets for propelling baseballs and softballs operate by taking advantage of the tension held in the net by a plurality of elastic bands, whereby the energy of the impact between the ball and the net is initially stored in the elastic bands. The stored energy is almost immediately transferred and released to the ball, allowing the ball to be accurately placed and propelled great distances.

However, one disadvantage of prior ball launching racquets is that their optimal performance is limited to a specific mode of operation, i.e., use as a fly ball or ground ball launcher. Thus, it should be appreciated that once a racket is set with a predetermined net tension, for instance a soft net tension, the racket is only suited for launching ground balls.

Another disadvantage of conventional launching rackets is that they have very limited cross-usage between different types of balls once the net tension is initially set. For example, once a racket is set with a tightly-tensioned net, (ideal for hardball applications) it is not well-suited for softball applications.

Another disadvantage of prior ball launching rackets concerns the racket structural arrangement for holding the elastomeric bands. Most of the previous designs are overly complex, making net tension-adjustments and net change-outs time consuming and frustrating. Moreover, many of the prior designs incorporate elastomeric bands that are formed with an aperture, open slit, or a reduced cross sectional area, thereby creating a localized area of highly concentrated stresses which cause the bands to prematurely wear and fail. A further disadvantage with using these types of bands is that they are not available as an over-the-counter purchase, meaning they must be repurchased from the racket manufacturer.

Therefore, it would be desirable to provide a ball launching racket that can be easily adapted to utilize commercially available elastomeric bands which can be expediently added or removed from the racket to adjust the net tension according to a specific type of hardball and softball application.

SUMMARY OF THE INVENTION

It is a principal object of the present invention to provide a sports racket for propelling softballs and baseballs, wherein the racket comprises a frame and a handle extending from the frame. The frame has a perimeter that defines a central opening, and a detachable net is disposed within the central opening. The net is under a continuous state of tension, wherein the net stores and releases the momentum energy of the softball or baseball to thereby launch the ball.

It is also a principal object of the invention to attach the net to the frame by a plurality of removable clips secured at spaced intervals about the frame, wherein a plurality of elastomeric bands hold the net in a state of tension, and wherein each elastomeric band is associated with a respective clip.

It is another object of the invention in a preferred form, that each of the elastomeric bands have a unitary, continuous construction of constant cross sectional thickness and width, being free of apertures and slits.

It is another object of the invention that the net perimeter be delimited by a flexible strand, wherein each elastomeric band is folded about said flexible strand, thereby forming a pair of ends which extend towards said frame and are attached thereto by the same clip.

It is another object of the invention in a preferred form that the removable clip comprise a base portion having opposed ends and a top portion integrally formed with said base portion, wherein the top portion includes a pair of spaced opposed arms, a respective arm integrally formed at a respective said end of said base portion, and that each of the arms receives a respective end of each of the elastomeric bands.

In this preferred form, each arm of the clip includes a respective upstanding portion that terminates in a hand portion, wherein each of the hand portions contacts the outside surface of the frame to prevent the elastomeric bands from disengaging from the arms of the clip. Each of the arms will be interposed between a respective end of said elastomeric band and that the elastomeric band be in restrained engagement between the upstanding portions of said clip and that the upstanding portions of the clip be adapted to provide a tolerance between said elastomeric band and said frame when said clip and said elastomeric band are secured to said frame.

It is still another object of the invention that the central opening of the frame is to be configured into one of the configurations selected from the group consisting of a circle, an oval, a rectangle, a square, and a triangle and wherein the net has a configuration which is substantially the same configuration of the central opening, and is spaced from the frame when disposed within the opening.

Yet still another object of the invention is to provide the same cross sectional thickness and width for each the elastomeric bands so that the net tension along the perimeter of the net is equal.

A final object of the invention is to provide a varied net tension about the perimeter of the net, whereby the cross sectional thickness and width of every other elasotmeric band is the same to the other.

BRIEF DESCRIPTION OF THE DRAWINGS

The various features and advantages of the present invention may be more readily understood with reference to the following detailed description taken in conjunction with the accompanying drawings, wherein the reference numerals designate the structural elements, and in which.

DETAILED DESCRIPTION OF THE PREFERRED EMBODIMENT

Figure 1:
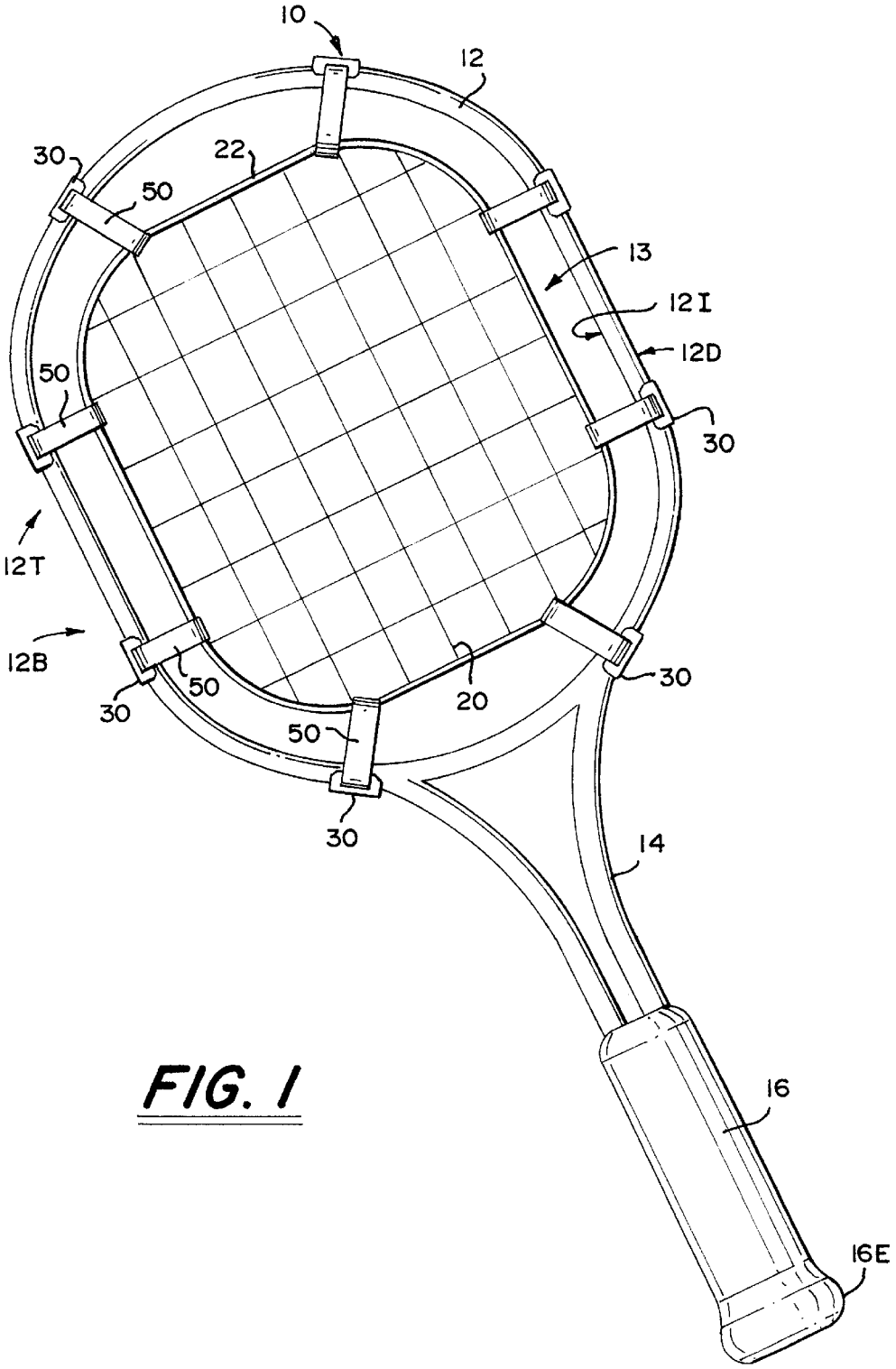
FIG. 1 is a perspective view of a ball launching racket according to the invention.

FIG. 1 generally shows the ball launching racket 10 of the present invention, comprising a net-retaining section 12, or frame, that includes an upper portion 12*t*, a lower portion 12*b*, and an elongate handle 14 that is interconnected to the frame 12. The frame 12 defines an opening 13 which may have a round or oval configuration, although the shape of the frame which defines the opening should not be considered to be limiting. It is seen that frame 12 has an outside surface 12*d* for receiving thereon a net retaining clip 30, as will be explained in greater detail herein. The frame 12 also has an inside surface 12*l* that faces frame opening 13. In one embodiment, the frame 12 and handle 14 may be constructed of a unitary, tubular metallic material, while in another embodiment, the unitary material is comprised of either wood or a composite.

The handle 14 extends downwardly and away from frame 12 by an extent which will facilitate comfort, control and stability to the user when launching balls, and may be of a the length that is at least equivalent to the extent of the size of the opening 13. The handle may include a grip 16 for facilitating the gripping of the racket, especially a perspiring palm. The grip may be comprised of various types of materials commonly used in racket sports, i.e., leather, foam rubber, etc., and may further include preformed finger grips (not shown) to further improve the gripping of the racket 10. The distal end 16*e* of the handle 16 may also be enlarged so as to prevent the racket slipping out of the hand of a user during use.

Figure 2:
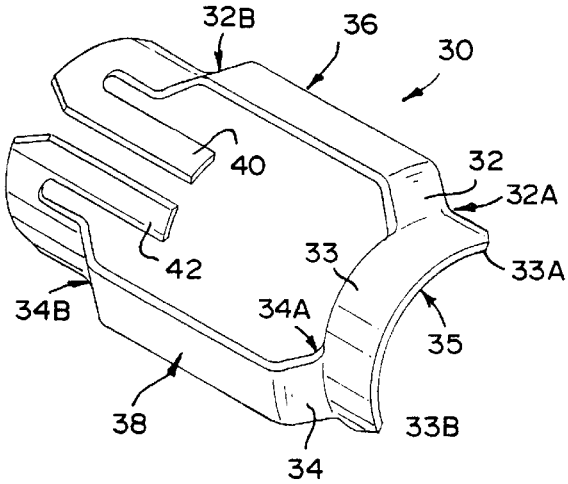
FIG. 2 is a perspective view of a retention clip according to the present invention, wherein the clip attaches the launching net to the racket frame.
Figure 3:
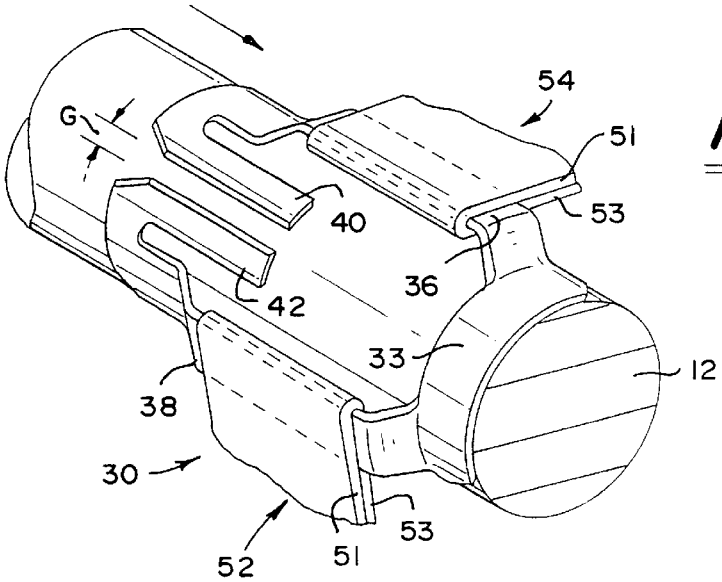
FIG. 3 is a perspective view of an elastomeric band and retention clip before the clip is attached to the frame of the launching racket.
Figure 4:
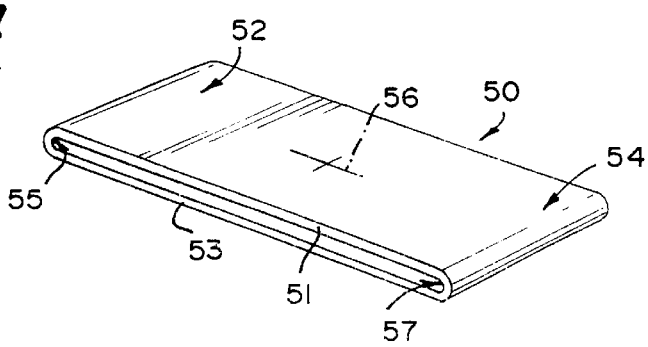
FIG. 4 is a perspective view of an elastomeric band used in accordance with the invention.

FIG. 1 also illustrates that a net 20 that functions to launch the ball from the racket, is disposed within the frame opening 13. The net 20 may be formed of interwoven nylon or polyester strands or cords that ultimately form an open grid pattern of substantially equally-sized apertures. The illustration shows the apertures being formed as squares, as defined by the pattern of the interwoven cords, although other patterns may be provided, such as a honeycomb or rectangular pattern, preferably so long as the apertures are of the same size. The perimeter of the net 20 is comprised of an outermost flexible strand or binding 22 that delimits the size of the launching net 20. The outermost strand 22 may be heavier than the interior interwoven cords and may be complementary to the configuration of the frame opening 13. The net 20 is secured to the frame 12 by a plurality of resilient elastomeric bands 50 which are looped around the outermost strand of the net at equally spaced locations from each other, thereby encircling the perimeter of the net. Each band 50 is attached to a set of arms 32, 34 of a respective anchoring clip 30, as best seen in FIGS. 2 and 3. Looping of the individual bands 50 is best understood by referring to the FIG. 4 illustration, where it is seen that each band 50 is formed as a continuous closed loop. When folded flat, each band 50 forms a pair of loop ends 52 and 54 that are defined from a combination of the top strand portion 51 and the bottom strand portion 53. The elastomeric band 50 is folded around the binding strand 22 such that the band center 56 of either the top or bottom strand portion 51 or 53, will be the only part of the elastomeric band 50 contacting the binding strand 22 of the net 20. Because each band 50 is formed as a continuous, closed loop, the looped ends 52 and 54 will be folded around the net binding 22, and the same two looped ends 52, 54, will be folded around a respective arm 32, 34 associated at each end 33*a* and 33*b* of the arcuately configured trunk 33 of clip 30. The trunk 33 forms a base portion of the clip, while the arms 32, 34 form a top portion. Each arm 32, 34, extends away from the base of the clip 30 in the same direction and the same extent. Each arm 32, 34 includes a respective proximate end 32*a* or 34*a*, and a respective terminal end 32*b* or 34*b*. Each of the proximate ends 32*a*, 34*a*, are integrally formed with trunk 33 at a respective end 33*a* or 33*b*. The terminal ends 32*b*, 34*b* of each arm 32, 34, include a respective hand portion 40, 42 that is integrally formed thereon. More specifically, the inside surface 55, 57 of each looped end 52, 54, is respectively in resting contact against an upstanding portion 36, 38 formed on each arm 32, 34. FIG. 3 shows that each loop end 52, 54, is slid in the direction of the heavy arrow and between the gap "G" existing between each arm 32, 34, such that the top strand portion 51 and the bottom strand portion 53 of each looped end 52, 54, is in effect, looped only about the respective upstanding portions 36 or 38 such that a respective arm 32, 34 is interposed between the strand portions comprising the respective elastomeric band 50. The remaining and opposite loop end 52 or 54 of each band is likewise looped about the other upstanding portion 36 or 38. In this way, one elastomeric band 50 will be strung around the binding strand 22 of the net 20 at a predetermined location, and then attached to the arms of a respective clip 30 so as to be restrained between the upstanding portions 36, 38. The clip is then attached to the racket frame 12 by pushing the base portion of the clip (the arcuately configured trunk 33) securely against the frame surface until the inside surface 35 of the trunk 33 is in resting contact against outside surface 12*d* of the frame 12 (FIG. 3). Due to the construction of upstanding portions 36, 38, a tolerance is provided between the arms 32, 34 of each clip 30 and the frame 12 when the clip/band assembly is secured to the frame 12. This tolerance facilitates holding the clip 30 and band 50 to the frame 12, otherwise, the thickness of the strands forming the elastomeric bands 50 would interfere and prevent the clip 30 from securely seating against the frame 12 if the upstanding portion 36, 38 were not provided. The hand portions 40, 42, of each arm 32, 34, also contact the outside frame surface 12*d* when the clip 30 is secured to the frame 12, thereby providing additional stability to the top portion of the clip 30, additionally helping the retain it against the frame 12. Furthermore, hand portions 40, 42, cooperate to prevent each of the looped ends 52, 54, of elastomeric band 50 from unworking themselves from the upstanding portions 36, 38 when in use. It is important that the clips 30 be positioned with the semi-circular portion of the trunk 33 encircling the outside surface 12*d* of the frame so that the tensile forces which continuously pull on the band 50 and keep the net 20 taunt, will also simultaneously pull the clip in contact against the outside surface 12*d* of the frame 12. In this way, the two looped ends 52, 54, of the elastomeric band 50 actually pulling on the clip 30 in a direction towards the net 20, while the center 56 of the band 50 is pulling on the net 20 in a direction towards the frame 12, and hence towards the clip 30. For this reason, it is not necessary that the trunk 33 of the clip 30 be made to frictionally snap-fit to the frame 12, although the clip 30 may be formed to frictionally snap-fit to the frame. Thus, it can be appreciated that since each looped end 52, 54, are continuously in a state of tension and are pulled towards the net 20, a tensile state condition will continuously exist in each looped end 52, 54, and in each strand 51, 53 (except for the area immediately around center 56), thereby maintaining clip 30 in a firmly secured fashion against the frame 12. This is especially true during use, where the tension forces in these same locations become even greater. The orientation of the clip arms 32, 34 with respect to the arms of an adjacent clip is not important to the function of the clip and band as an assembly.

As FIG. 1 shows, the racket there is provided with eight clips 30 and eight elastomeric bands 50, thereby forming eight assemblies, although a plurality of additional assemblies can be expediently added to the frame as a means to stiffen the tension in the net 20 and to expediently change the launching characteristics of the racket. Likewise, the clip and band assemblies can be expediently removed from the frame 12 to create a soft or spongy net tension, which is akin to a racket performance best suited for launching pop flies. It should be understood that when viewing FIG. 1, the net 20 is provided with a complementary configuration to that of the frame 12. However, the net 20 will be smaller than the frame opening in order to ensure that the elastomeric bands 50 will remain in a taunt state during non-launching periods and have clearance from the frame 12 in order to unrestrictively stretch during launching periods. This clearance further allows the net to freely move within the central opening 13 of the frame 12 and transfer its stored energy to the ball. However, the size of the net should not be made too small, so as to compromise the surface contact between the ball and the net.

Another advantage of the present launching racket is that it can be converted for use with baseballs although it might have been initially set for use with softballs. Since a baseball is harder and less deformable than a softball, a hardball will absorb less impact energy when contacted against the net 20. Moreover, when the racket 10 is to be used with baseballs, a generally softer, more spongy net tension is desired. Thus, several clip/elastomeric band assemblies can be expediently removed to create this condition. Alternatively, all of the elastomeric bands 50 can be replaced with elastomeric bands of a different tensile strength, which of course, is factor controlled by the physical dimensions (width, strand thickness, rubber composition) of the band itself. One of the most favorable advantages of the present racket is that the elastomeric bands are free from apertures or slits therein, meaning that stress concentration points along the apertures or slits, are eliminated, thus eliminating the potential for premature failure. Since most bands incorporating apertures or slits require custom manufacture, the present racket may incorporate the use of over-the-counter, heavy-duty rubber bands that are available to public in most retail office supply stores.

The above mentioned embodiments are exemplary only and it is envisioned that various modifications can be made without departing from the scope of the present invention which is to be limited only by the appended claims.

I claim:

1. A racket for propelling softballs and baseballs, comprising:

a frame having a perimeter which defines a central opening and a handle extending from an end of said frame;

a detachable net defined by a perimeter, said net disposed within the central opening of said frame;

a plurality of clips spaced about said frame, each of said clips removably attached to said frame and comprised of a base portion having opposed ends and a top portion integrally formed with said base portion, said top portion including a pair of spaced opposed arms, wherein a respective arm is integrally formed at a respective said end of said base portion;

a plurality of elastomeric bands disposed at spaced intervals about said net perimeter for holding said net in a state of tension within said central opening, each elastomeric band associated with a respective clip, such that all of said elastomeric bands are interconnected between a respective clip and said net, wherein each of said elastomeric bands has a unitary, continuous construction of constant cross sectional thickness and width, being free of apertures and slits and wherein each band is folded about said net perimeter, thereby forming a pair of ends which extend towards said frame and are attached to the spaced arms of said clip, and wherein each of said arms receives thereon a respective end of each of said elastomeric bands.

2. The racket of claim 1, wherein the net perimeter is delimited by a flexible strand.

3. The racket of claim 1, wherein each of said arms includes a respective upstanding portion, each upstanding portion terminating in a hand portion.

4. The racket of claim 3, wherein each of said arms are interposed between a respective end of said elastomeric band, said elastomeric band in restrained engagement between said upstanding portions of said clip.

5. The racket of claim 4, wherein said upstanding portions of said clip are adapted to provide a tolerance between said elastomeric band and said frame when said clip and said elastomeric band are secured to said frame.

6. The racket of claim 3, wherein each arm has a terminal end, with each terminal end having a respective hand portion integrally formed thereon, each of said hand portions contacting said outside surface of said frame when said clip is attached to said frame, each of said hand portions preventing said elastomeric band from disengagement with said arms of said clip.

7. The racket of claim 1, wherein said central opening has a configuration that corresponds to one of the configurations selected from the group consisting of a circle, an oval, a rectangle, a square, and a triangle.

8. The racket of claim 7, wherein said net is of a configuration which is substantially the same configuration of said central opening.

9. The racket of claim 8, wherein said perimeter of said net is spaced from said frame when said net is disposed within said central opening.

10. The racket of claim 1, wherein said cross sectional thickness and width of all of said elastomeric bands are the same such that said net tension along the perimeter of the net is equal.

11. The racket of claim 1, wherein said net tension about the perimeter of the net is varied, whereby the cross sectional thickness and width of every other elasotmeric band disposed about the perimeter of the net is the same.

12. The racket of claim 11, wherein the elastomeric bands disposed in between the every other elastomeric bands have the same cross sectional thickness and width, which said cross sectional thickness and width is different from the cross sectional width and thickness from that of the every other elastomeric band.

* * * * *